US010629169B2

(12) United States Patent
Oberg

(10) Patent No.: US 10,629,169 B2
(45) Date of Patent: Apr. 21, 2020

(54) MUSICAL INSTRUMENT

(71) Applicant: Robert L. Oberg, Syosset, NY (US)

(72) Inventor: Robert L. Oberg, Syosset, NY (US)

( * ) Notice: Subject to any disclaimer, the term of this patent is extended or adjusted under 35 U.S.C. 154(b) by 0 days.

(21) Appl. No.: 15/985,449

(22) Filed: May 21, 2018

(65) Prior Publication Data

US 2018/0336868 A1 Nov. 22, 2018

Related U.S. Application Data

(63) Continuation of application No. 15/852,127, filed on Dec. 22, 2017, now abandoned, and a continuation of application No. 15/659,438, filed on Jul. 25, 2017, now Pat. No. 9,978,346.

(60) Provisional application No. 62/366,346, filed on Jul. 25, 2016.

(51) Int. Cl.

| | |
|---|---|
| ***G10D 1/08*** | (2006.01) |
| ***G10H 1/32*** | (2006.01) |
| ***G10D 3/04*** | (2020.01) |
| ***G10D 3/12*** | (2020.01) |

(Continued)

(52) U.S. Cl.

CPC ..... *G10D 1/08* (2013.01); *G10D 3/02* (2013.01); *G10D 3/04* (2013.01); *G10D 3/12* (2013.01); *G10H 1/32* (2013.01); *G10H 3/18* (2013.01); *G10H 3/185* (2013.01); *G10H 2220/501* (2013.01)

(58) Field of Classification Search

CPC .. G10D 3/02; G10D 1/08; G10D 3/00; G10D 9/00; G10H 1/32

See application file for complete search history.

(56) References Cited

U.S. PATENT DOCUMENTS 1,385,795 A * 7/1921 Ries ..... G01S 1/72 342/350

3,696,700 A * 10/1972 Berardi ..... G10D 1/085 84/291

(Continued)

*Primary Examiner* — Marlon T Fletcher

(74) *Attorney, Agent, or Firm* — Scarinci Hollenbeck, LLC; Libby Babu Varghese

(57) ABSTRACT

A musical instrument having a hollow or semi-hollow body and a sound board, representing either the anatomical front surface or the anatomical rear surface of the hollow body, or with the front surface and the rear surface both functioning as a sound board for the musical instrument and having at least one tuned sound port located in either the front and/or rear sound board of the musical instrument through which sound can exist with the tuned sound port comprising a hollow member adapted to be inserted through a hole formed in one or both of the sound boards and having a central opening of predetermined geometry and a length extending a fixed distance from the sound board into the interior of the musical instrument of between 5% and 95% of the distance between the front rear sound surfaces of the musical instrument. The musical instrument is preferably a stringed musical instrument which may include a plurality of panels extending between the front and rear sound boards for enhancing the structural support of the musical instrument and for funneling sound through the tuned sound ports or alternatively the musical instrument may include a plurality of panels extending between the front and rear surfaces without a tuned sound port.

20 Claims, 4 Drawing Sheets

(51) Int. Cl.
*G10H 3/18* (2006.01)
*G10D 3/02* (2006.01)

(56) References Cited

U.S. PATENT DOCUMENTS 5,918,299 A * 6/1999 Yui ..... G10D 3/02 84/291
5,922,979 A * 7/1999 Yui ..... G10D 3/02 84/291
5,952,591 A * 9/1999 Thurman ..... G10D 3/02 84/267
6,605,765 B1 * 8/2003 Johnson ..... G10D 1/00 84/267
2005/0155480 A1 * 7/2005 Joseph ..... G10D 1/00 84/299
2006/0054001 A1 * 3/2006 Schmidt ..... G10D 3/02 84/294
2008/0223192 A1 * 9/2008 Linden ..... G10D 3/02 84/296
2010/0139473 A1 * 6/2010 Umeda ..... G10D 3/02 84/294
2010/0307313 A1 * 12/2010 Zoran ..... G10D 1/085 84/192
2011/0314994 A1 * 12/2011 Glass ..... G10D 3/00 84/453
2012/0097007 A1 * 4/2012 Barillaro ..... G10D 3/02 84/291
2012/0234153 A1 * 9/2012 D'Anda ..... G10D 3/02 84/294
2013/0032019 A1 * 2/2013 Miloslavsky ..... G10D 3/02 84/291
2014/0013929 A1 * 1/2014 El-Khadem ..... G10H 3/18 84/726
2018/0025705 A1 * 1/2018 Oberg ..... G10H 1/32 84/731

* cited by examiner

MUSICAL INSTRUMENT

The present invention is a continuation of U.S. patent application Ser. No. 15/659,438 filed on Jul. 25, 2017 and a continuation of U.S. patent application Ser. No. 15/852,127 filed on Dec. 22, 2017, the disclosure of each being incorporated herein by reference and, more particularly, is particularly directed to a stringed musical instrument such as a guitar, violin or banjo having at least one sound port through which sound can pass in addition to or in place of a sound hole for improving the overall tonal quality of the stringed musical instrument. The U.S. patent application Ser. No. 15/659,438 filed on Jul. 25, 2017 in turn claims priority to U.S. Provisional Application Ser. No. 62/366,346, filed on Jul. 25, 2016.

BACKGROUND OF THE INVENTION

Field of the Invention

Conventional stringed musical instruments generate musical tones by strumming or plucking strings stretched over either a bridge and/or saddle mounted on the sound board of the musical instrument. Sound is produced by the vibration of the strings and is transmitted from the bridge and/or saddle mounted upon the sound board, throughout the body of the musical instrument ultimately exiting through a conventional sound hole or holes in the musical instrument. The sound hole(s) in a conventional stringed musical instrument constitutes a perforated hole(s) formed in the body of the musical instrument, usually in the anatomical front sound board of the musical instrument, at a location underneath or adjacent the strings for allowing sound to travel throughout the interior of the musical instrument and to exit into the atmosphere.

In an acoustical guitar the interior of a hollow or semi-hollow body forms an acoustical resonant enclosure which enhances and amplifies the sound generated from the sound board. The sound board of a stringed musical instrument is conventionally understood to represent the anatomical top or front board of the instrument but in accordance with the present invention both or either the front and/or rear boards may function as a sound board for the instrument.

Heretofore, most conventional stringed musical instruments, particularly guitars, have been constructed with a multiplicity of ribs placed on the inside surface of the front and/or rear sound boards facing the interior of the instrument to increase the structural strength of the musical instrument without diminishing or cancelling sound waves produced from sonic energy resonating throughout the body of the musical instrument in response to string vibrations. As a result of this thinking, no structural support exists in a conventional acoustical musical instrument such as a guitar and/or banjo which does not include a plurality of ribs other than for the support provided by the bouts and outer rim of the instrument which connect the front sound board to the rear sound board.

It has been discovered in accordance with the present invention that sound produced from a musical instrument, particularly a stringed musical instrument, can be enhanced to improve the overall tonal output and quality of the musical instrument by incorporating at least one tuned sound portin the body of the musical instrument preferably in either one or both sound boards of the musical instrument and preferably in addition to, or in place of, a conventional sound hole through which sound can exist. A tuned sound port is defined and disclosed in applicant's aforementioned continuation patent application Ser. No. 15/659,438, the disclosure of which is incorporated herein by reference, as comprising a hollow member of any desired geometry, preferably in the form of a tube, adapted to be inserted through an opening formed in the body of the musical instrument preferably one of the sound boards, such as the anatomical front sound board, with the hollow member having a length extending from the sound board in which it is inserted to a location within the hollow or semi-hollow body of the instrument equal to between 5% and 95% of the distance between the front and rear sound boards. The tuned sound port of the present invention may have any desired geometrical configuration preferably cylindrical or parabolic. The tuned sound port of the present invention is "tuned" for any given port geometry by varying the extended length which the tuned sound port protrudes into the interior of the instrument so that it protrudes a minimum distance of at least between ¼ and ½ of the diameter of the ported opening within a range of plus or minus 20%, until the sound passing through the tuned sound port possesses a desired frequency range proportional to the resonant frequency of the musical instrument, e.g. by tuning the tuned sound port to occupy a higher and/or lower frequency spectrum corresponding to a treble or bass sound range relative to the frequency spectrum of sound exiting a conventional sound hole for the same musical instrument and thereby creating a greater dynamic frequency range for the musical instrument. Moreover, with multiple tuned ports each tuned port can be individually tuned to a desired frequency spectrum which may be different from one another.

It has been further discovered in accordance with the present invention that the structural integrity of a stringed musical instrument having a hollow or semi-hollow body can be enhanced using panels extending between the front and rear sound boards to provide structural support to the musical instrument in lieu of adding ribs to either the front or rear sound boards or having to add a brace in a violin between the "f sound holes". The addition of such panels will not interfere with the transmission of sonic energy from the vibration of the strings in the musical instrument and, in fact, when used in addition to the inclusion of a tuned sound port actually functions as a vent for enhancing the sonic output from the tuned sound port(s). This has been discovered to apply to all stringed musical instruments inclusive of a guitar and banjo and equally to a violin, bass violin and cello. In this regard, the inclusion of panels between the front and rear sound boards, when properly arranged, will not only structurally support the stringed musical instrument but will also function to funnel or vent sound through the tuned sound port(s) thereby increasing the sonic output and enhance the frequency range through the tuned sound ports. The panels extending between the front and rear sound boards can be flat straight panels or curved panels. A curved panel having a serpentine or sinusoidal shape corresponding to the letter "S" is the preferred curvature.

A tuned port can be incorporated into any conventional stringed musical instrument with or without the addition of panels to enhance the overall tonal quality of the instrument. Moreover, the stringed musical instrument may use a single bridge as in a conventional guitar or violin or in a stringed musical instrument having a dual bridge arrangement, as is specifically taught in U.S. patent application Ser. No. 15/659,438, the disclosure of which is herein incorporated by reference. Moreover, a conventional stringed musical instrument, such as an acoustical guitar, which includes a tuned port will add to the sonic performance of the stringed musical instrument with or without the use of electronics within or external to the instrument.

SUMMARY OF THE INVENTION

The musical instrument of the present invention comprises a body which is hollow or semi-hollow having a front surface and a rear surface and having at least one tuned sound port through which sound can exist from the musical instrument into the atmosphere with the tuned sound port extending through the body into the interior of the musical instrument and/or including a plurality of panels interconnecting the front surface to the rear surface. When the musical instrument is a stringed musical instrument the musical instrument further comprises a sound board representing either the anatomical front or anatomical rear surface of the body, or with both the front and rear surfaces each functioning as a sound board for the musical instrument. The tuned sound port comprises a hollow member adapted to be inserted through a hole formed in one or both of the sound boards with the hollow member having a central opening of predetermined geometry and a length extending into the interior of the musical instrument of between 5% and 95% of the distance between the front rear sound boards and having an optimum length based on extending a minimum distance into the interior of the musical instrument equal to at least between ¼ and ½ of the diameter of the ported opening within a range of plus or minus 20%. When the stringed musical instrument includes at least two tuned sound ports each may be symmetrically or asymmetrically located in the musical instrument and when the stringed musical instrument has a conventional sound hole and tuned sound ports, the tuned sound ports may be located on opposite sides of the conventional sound hole.

The body of the stringed musical instrument of the present invention should further comprise flat or curved panels interconnecting the front and rear sound boards for providing additional support for the musical instrument and for venting or funneling sound through each tuned sound port respectively. Each curved panel should preferably have a serpentine or sinusoidal shape corresponding to the letter "S". The panel or panels may be arranged adjacent to one or both opposite sides of the instrument or asymmetrically arranged and may lie between one side of the musical instrument and a tuned sound port or between tuned sound ports. The arrangement and length of each of the panels within the interior of the musical instrument and between the sound boards are variables which will affect the sound outputted from a tuned sound port. In general one end of each panel may extend a desired distance from a position relatively close to an end of the instrument or when there are two panels each panel should preferably extend in a symmetrical or asymmetrical arrangement from opposite ends of the instrument to a location relatively near the center of the instrument.

BRIEF DESCRIPTION OF THE DRAWINGS

Other advantages of the subject invention will become apparent from the following detailed description of the invention when read in conjunction with the accompanying drawings of which.

DETAILED DESCRIPTION OF THE INVENTION

All of the drawings are directed to a preferred embodiment of the musical instrument of the present invention represented by either a guitar or a violin including at least one tuned sound port extending within the interior of the musical instrument and/or having a plurality of panels for providing structural support to the body of the musical instrument and for funneling sound through a tuned sound port, if present without limiting the scope of the invention.

Figure 1:
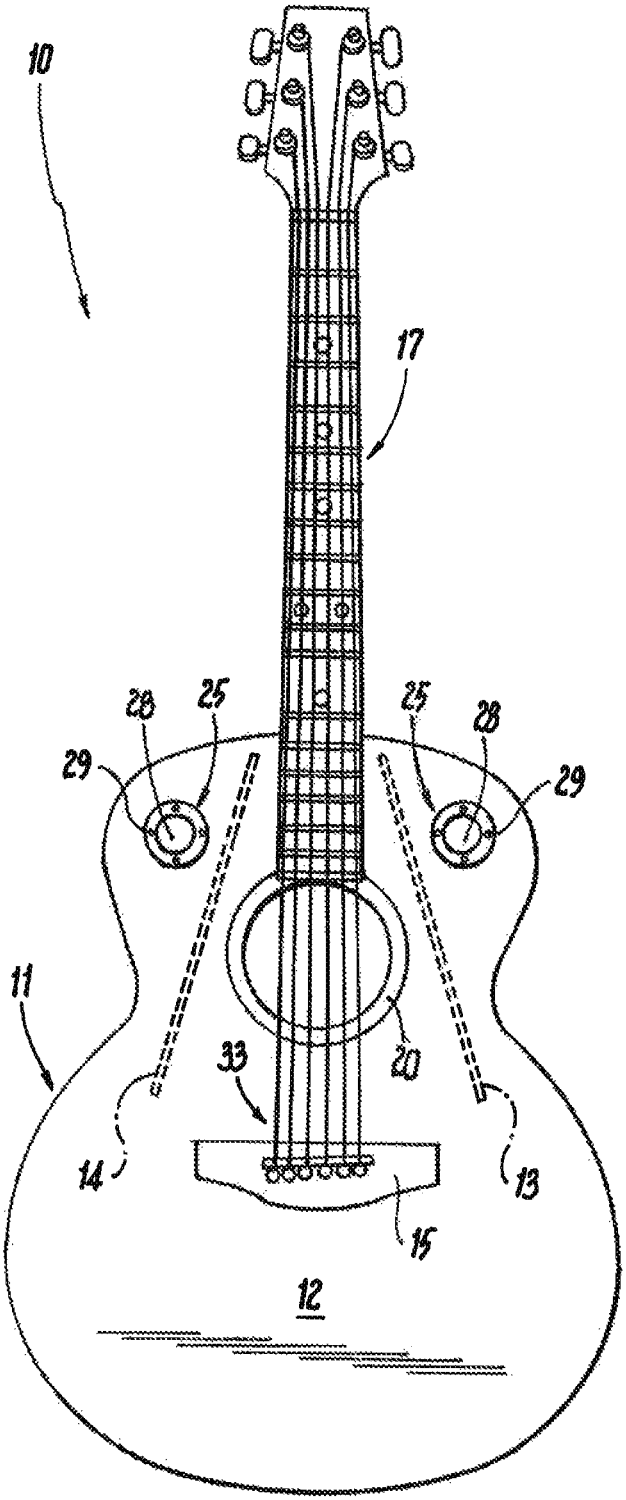
FIG. 1 is an anatomical front view of a preferred embodiment of the present invention for an acoustical guitar having a central sound hole, a plurality of tuned sound ports and a plurality of panels extending within the interior of the musical instrument between the front board and the rear board thereof.
Figure 4:
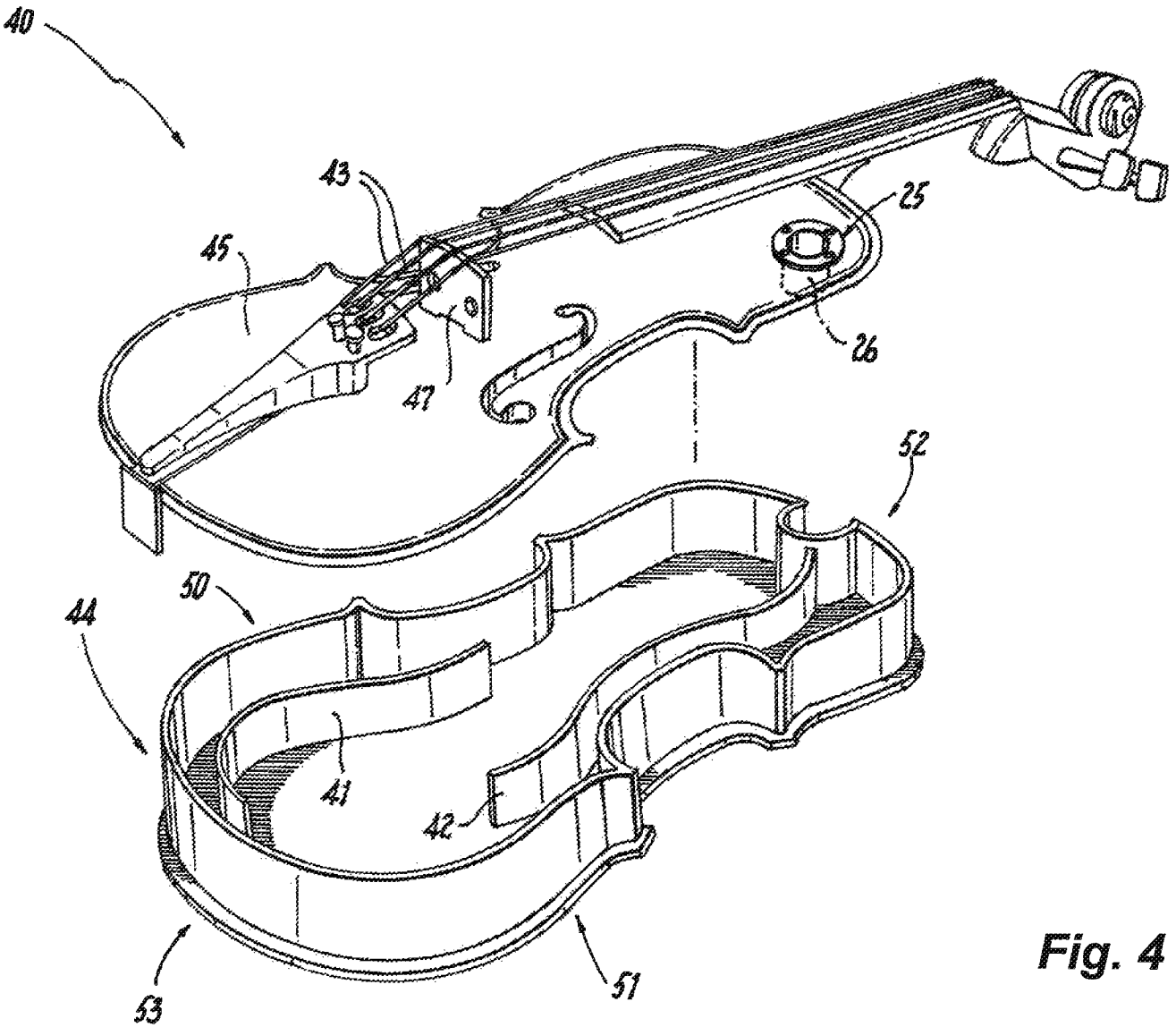
FIG. 4 is an exploded perspective view of an alternative embodiment of the present invention represented by a conventional violin having at least one tuned sound port and a plurality of curved serpentine panels disposed between the front and rear sound boards.

The musical instrument of the present invention is illustrated in FIG. 1 by a conventional acoustical guitar 10 having a hollow or semi-hollow body 11 and in FIG. 4 by a conventional violin 40 having a hollow or semi-hollow body 44 with each of the musical instruments 10 and 40 having at least one tuned sound port 25 and preferably also including a plurality of panels which may be flat and/or curved with the panels extending within the interior of the musical instrument between the anatomical front and the anatomical rear board respectively as elaborated upon hereinafter.

Figure 2:
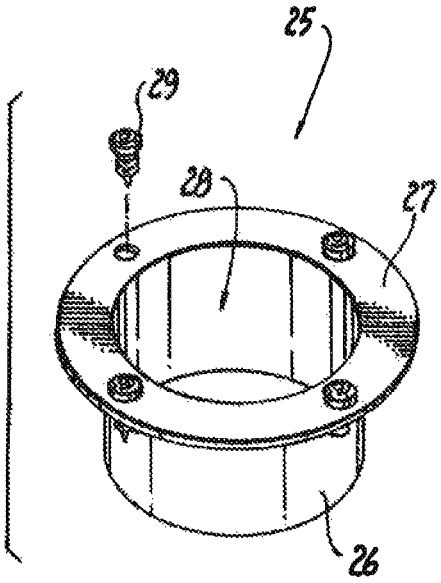
FIG. 2 is an exploded view in perspective of one of the tuned sound ports in FIG. 1.

An exploded view of a tuned sound port 25 in accordance with the present invention is shown in FIG. 2 with the tuned sound port 25 comprising a hollow member 26 having an outer rim 27 and a central opening 28. The tuned sound port 25 may be formed by perforating a hole in a sound board with the outer rim 27 secured to the anatomical front sound board 12 of the guitar as shown in FIG. 1 or secured to the anatomical front sound board 14 of the violin 40 as shown in FIG. 4 using, for example, conventional screws 29. Alternatively, the tuned sound port 25 may extend into the interior of the musical instrument through a side (not shown) in the body 11 of the musical instrument. The hollow member 26 may have any desired geometrical configuration although a cylindrical or parabolic configuration is preferred. The hollow member 26 should extend a fixed distance into the interior of the musical instrument and project either from a sound board or from any other location in the body 11 of the musical instrument through which the tuned sound port 25 is inserted with the hollow member 26 protruding a distance equal to between 5% and 95% of the distance between the front and rear sound boards of the musical instrument. The optimal length of the hollow member 26 having a cylindrical configuration extends into the interior of the musical instrument a minimum distance at least equal to between ¼ and ½ of the diameter of the ported opening within a range of plus or minus 20% to enhance the tuning of most acoustical guitars. It should be understood however, that each tuned sound port 25 may be of a different size and geometry so that each tuned sound port 25 can be separately tuned to a different frequency spectrum relative to each other and relative to the frequency spectrum of the sound which would emanate through a conventional sound hole if present in the guitar 10.

Figure 3:
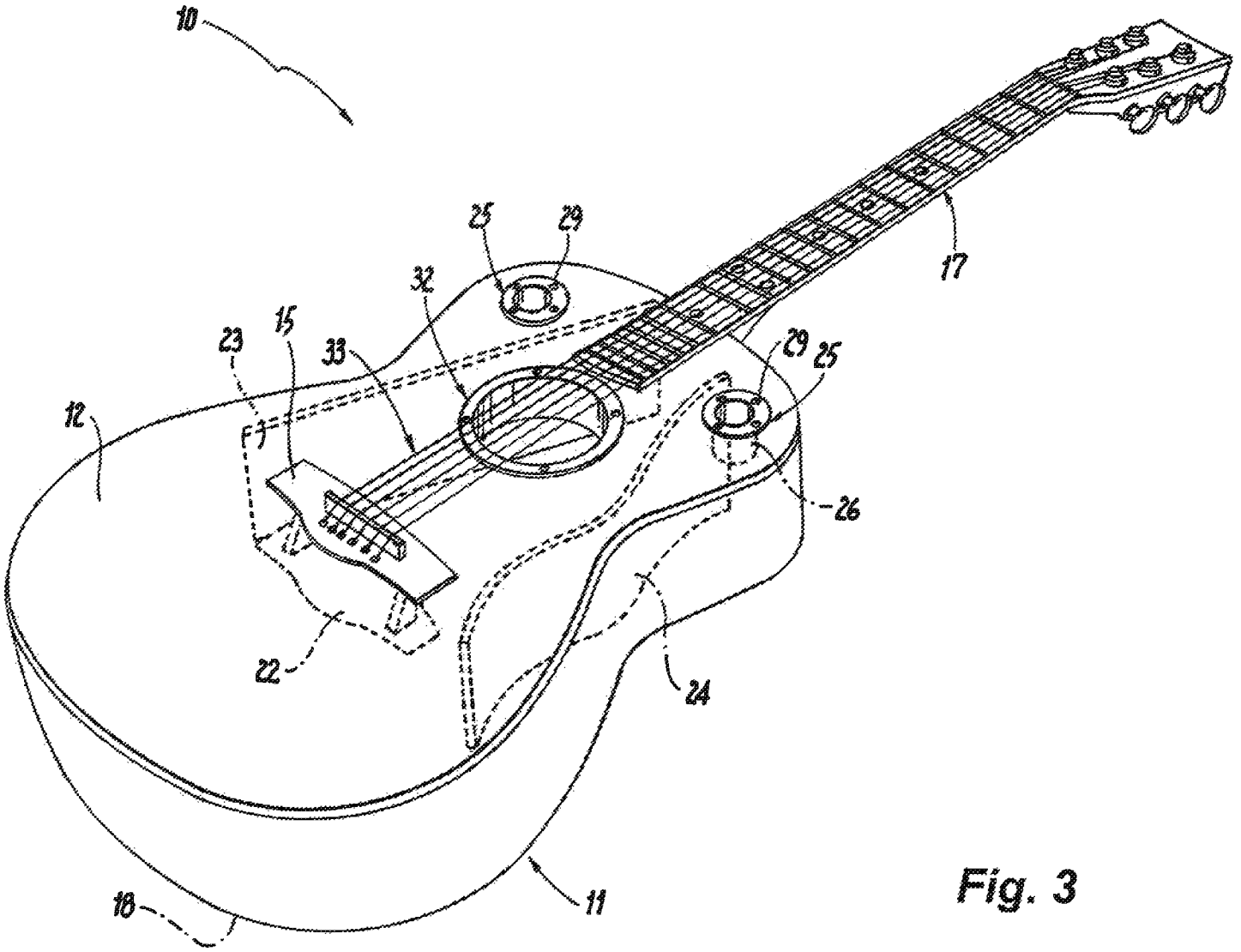
FIG. 3 is a perspective view of a variation of the guitar shown in FIG. 1 having a tuned sound port instead of a conventional sound hole, having a plurality of panels ne of which is a curved serpentine panel and the other is a straight flat panel similar to the flat panel shown in FIG. 1 and further having a dual bridge and saddle arrangement which enables both the front and rear boards of the musical instrument to function simultaneously as sound boards.
Figure 5:
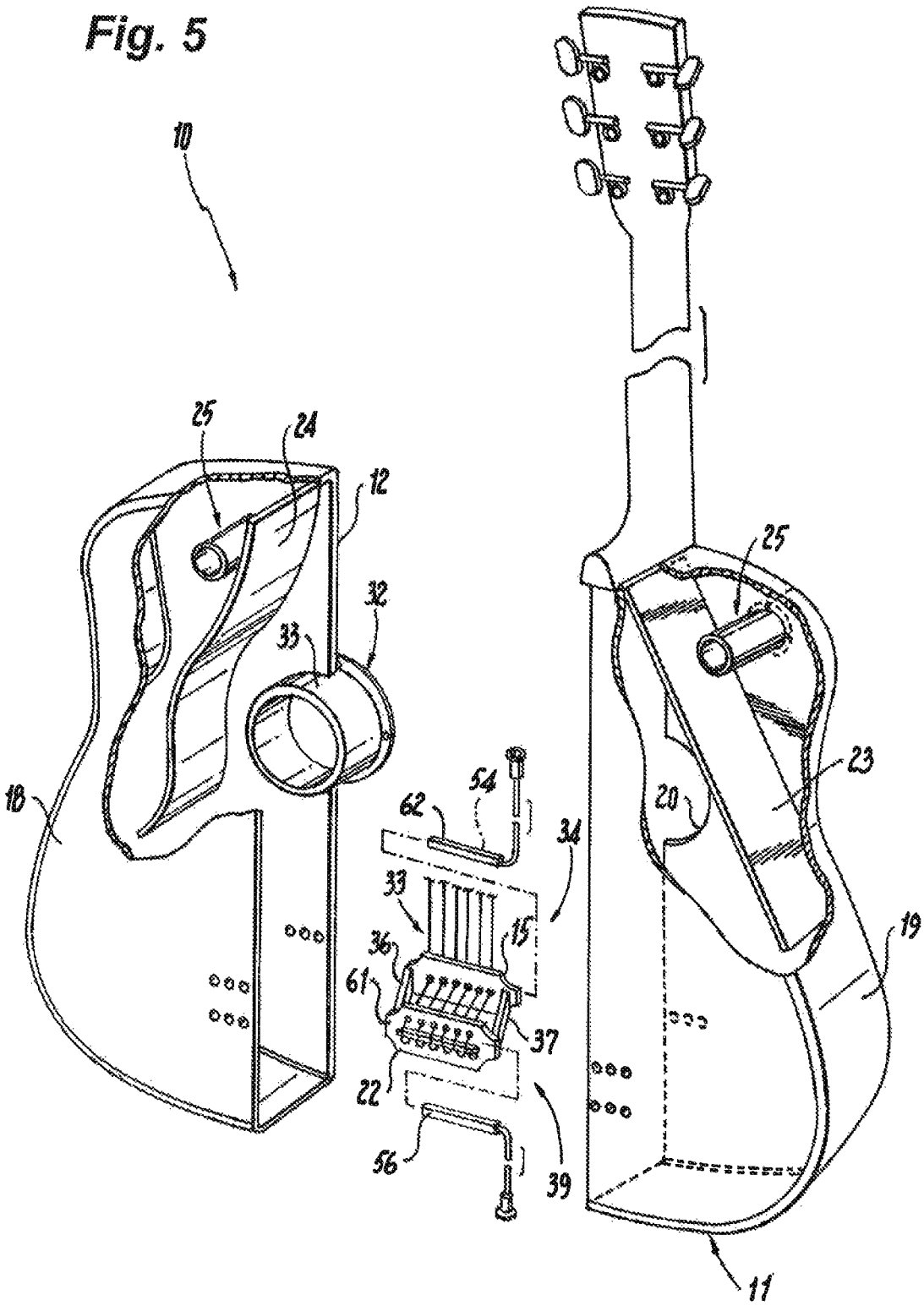
FIG. 5 is an exploded view in perspective of the guitar shown in FIG. 3 taken from the rear side of the guitar to highlight the arrangement between the tuned sound ports and the panels and showing an exploded version of a dual bridge and saddle arrangement for interconnecting the front and rear sound boards in combination with transducer pick up units for providing multiple independent electronic outputs.

When the musical instrument is a guitar 10, as shown in FIG. 1, it should include a plurality of panels 13 and 14 extending within the body 11 of the guitar 10 between the front sound board 12 and the rear sound board 18 and likewise, when the musical instrument is a violin 40, as shown in FIG. 4, it should similarly include a plurality of panels 41 and 42 disposed within the body 43 of the violin 40 extending between the front sound board 44 and the rear board 47. The panels 13 and 14 in the guitar 10 of FIG. 1 may be flat straight panels as shown or curved panels or both flat and curved panels. The flat panels in the guitar 10 in FIG. 1 lie within a single plane whereas panel 23 in the guitar 10 of FIG. 3 is flat and the panel 24 has a serpentine curvature. Similarly the guitar of FIG. 5 shows both a flat panel 23 and a curved panel 24. In all cases the panels should interconnect the front sound board 12 to the rear sound board 18 of the guitar 10 and extend transverse to both the front and rear sound boards 12 and 18 respectively. The panels 13,14 may be connected to the front and rear sound boards simply by using an adhesive and should preferably be positioned within the guitar 10 to lie between a tuned sound port 25 and the strings 33 of the guitar 10 to form a passageway for sound to be funneled toward and through at least one of the tuned sound port(s) 25.

The panels 41 and 42 in the violin 40 are preferably both curved in geometry or are identical to the curvature of the panels 23 and 24 in the guitar 10 of FIG. 3. The panels 41 and 42, when curved, should possess a serpentine or sinusoidal shape generally corresponding in shape to the letter "s". The flat and/or curved panels in the guitar 10 may extend from a position relatively close to the lower bout of the guitar 10 to a position near an end of the guitar 10 adjacent the neck 17 or alternatively so that one end of each panel intersects one another near the neck 17 of the guitar 10. This will also permit sound to be funneled or vented toward the tuned sound ports 25. Although only two flat panels 13 and 14 are shown in the guitar 10 of FIG. 1 and FIG. 3 shows both a flat panel 33 and a curved panel 34 both panels may be curved or flat and additional flat and/or curved panels may be used to form a sound labyrinth within the interior of the body 11 of the musical instrument.

The guitar as shown in FIG. 3 is substantially equivalent to the guitar 10 of FIG. 1 except for the use of a straight panel 23 and a curved panel 24 as opposed to flat straight panels 13 and 14 and shows a tuned sound port 32 in place of the sound hole 20. The tuned sound port 32 may be equivalent in geometry to any one of the tuned sound ports 25 of FIG. 1 although it may be sized to be dimensionally larger than the size of the corresponding tuned sound port 25. However, if the tuned sound port 32 is larger in size the length of its hollow member 33 as shown in FIG. 5 may be somewhat shorter relative to the length of the smaller sized hollow member 26 of the tuned sound port 25 so that the smaller sized tuned sound ports 25 may extend somewhat further into the interior of the musical instrument compared to the larger sized tuned sound port 32. In addition, the guitar 10 in FIG. 3 includes a dual bridge and saddle arrangement having a first bridge 20 mounted on the front sound board 12 of the guitar 10, a second bridge 22 mounted on the rear sound board 18 with each bridge having a saddle assembly the arrangement of which will be discussed in greater detail in connection with FIG. 5.

The violin 40 in FIG. 4 is a conventional violin with the strings 43 strung over a bridge 47 of conventional design interposed between the strings 43 and the sound board 44 to elevate the strings 33 into a predetermined elevated position above the sound board 44. Although only one tuned sound port 25 is shown in the violin 40 additional tuned sound ports 25 may be included and if more than one is included they should be preferably arranged to lie symmetrical to one another on opposite sides or opposite ends of the violin 40. The tuned sound port 25 in the violin 40 is the same as the tuned sound port 25 for use in a guitar 10 but may have a different geometry and have a length selected to tune the tuned sound port 25 to a frequency range proportional to the resonant frequency of the violin 40. Moreover, two tuned sound ports 25 may be used in a violin 40 on symmetrically opposite sides similar to the arrangement shown in the guitar in FIG. 1. The curved panels 41 and 42 in the violin 40 should be arranged on the opposite sides 50 and 51 of the violin 40 in alternating positions to prevent the cancelation of sound waves resulting from the presence of two tuned sound ports 25 lying in a common plane. Each curved panel 41 and 42 may extend from an opposite end 52 and 53 of the violin 40 to a position relatively near the center of the violin 40 for preferably forming a lane or space for funneling sound toward and through each tuned sound port 25 in the violin 40.

FIG. 5 is an exploded view in perspective of the guitar of FIG. 3 shown from the rear of the guitar having a dual bridge and saddle arrangement comprising a first bridge 20 adapted to be mounted to the anatomical front sound board 12, a second bridge 22 adapted to be mounted to the anatomical rear sound board 18, sonic support posts 36 and 37 interconnecting the first bridge 20 to the second bridge 22, a first saddle assembly 34 and a second saddle assembly 39. The side 19 of the guitar 10 connects the front sound board 12 to the rear sound board 18 to fully enclose the body of the guitar 10. A single set of strings 33, of custom length, extends from the headstock of the guitar 10 along the neck 17 of the guitar 10 over the first saddle assembly 34 in the first bridge 20 through the openings 35 in the first bridge 20 and then pass through the hollow interior within the body 11 of the guitar 10 over the second saddle assembly 39 with the strings 33 affixed or pegged into the holes 60 in the second bridge 22. This arrangement is disclosed in detail in applicants corresponding application Ser. No. 15/659,438 which is incorporated herein by reference. The support posts 36 and 37 in the dual bridge function to support and secure the upper sound board 12 of the guitar 10 to the rear sound board 18 so that neither the front and/or rear sound boards 12 and 18 collapse from too much tension when stringing the guitar strings 33. When support posts 36 and 37 are used they provide additional sonic structural support for the musical instrument.

In a dual bridge arrangement as shown in FIG. 5 the first bridge 20 is connected to the front sound board 12 of the guitar 10 and the second bridge 22 is connected to the rear sound board 19 of the guitar 10. Each saddle assembly 34 and 39 may represent a combination of a conventional saddle and a conventional transducer pick up with both saddle assemblies or at least the saddle assembly 39 being preferably constructed with a conventional transducer pick up 56 directly integrated into the body of the saddle 61 of the saddle assembly 39 for forming an improved saddle pick up unit for the bridge and saddle assembly as taught in the aforementioned continuation application Ser. No. 15/659,438 and Ser. No. 15/852,127 which are incorporated herein by reference. However, it should be understood that if the guitar has only one bridge and saddle assembly such as 34 in guitar 10 of FIG. 1, the saddle assembly 34 may have a saddle body 62 as shown in FIG. 5 which incorporates a conventional transducer pick up 54 within the body 62 of the saddle assembly 34. Each transducer pick up in each saddle assembly 34 and/or 39 may be connected through a conventional outlet jack to a different conventional preamp (not shown) which may, in turn, be connected through one or more external conventional amplifiers (not shown) for individually controlling sound from each preamplifier.

What is claimed is:

1. An acoustic musical instrument comprising:

an acoustic body having a hollow or semi-hollow interior, a front and rear surface and a sound board representing either the anatomical front surface or the anatomical rear surface of the hollow body, or with the front surface and the rear surface both functioning as a sound board for the musical instrument, an outer rim connecting the front surface and the rear surface, and a top end and a bottom end and having at least one tuned sound port defined in a top end, said tuned port extending into the interior of the musical instrument through which sound can exit with the tuned sound port comprising a hollow member adapted to be inserted through a hole formed at the top end of the musical instrument and having a central opening of predetermined geometry and a length extending a fixed distance from the hole through which the tuned sound port is inserted, wherein the length of the hollow member extends into the interior of the musical instrument a minimum fixed distance equal to at least ¼ of the diameter of the central opening of the port and within a range of plus or minus 20%; and a sound hole other than the tuned sound port.

2. A musical instrument as defined in claim 1 wherein the musical instrument is a stringed musical instrument with the tuned sound port inserted through a hole formed in at least the anatomical front or rear sound board of the musical instrument with the hollow member extending into the interior of the musical instrument a fixed distance equal to between 5% and 95% of the distance between the front and rear sound boards.

3. A musical instrument as claimed in claim 2 wherein the hole through which the tuned sound port extends is round and the hollow member has a cylindrical or parabolic configuration.

4. A musical instrument as claimed in claim 1, wherein the length of the hollow member extends into the interior of the musical instrument a minimum fixed distance equal to at least ½ of the diameter of the central opening of the port and within a range of plus or minus 20%.

5. A musical instrument as claimed in claim 1, further comprising at least one panel disposed within the hollow body, each said panels extending between the front and rear sound boards and interconnecting the front and rear sound boards.

6. A musical instrument as claimed in claim 5, wherein the panel has a flat geometry.

7. A musical instrument as claimed in claim 5, wherein the panel has a curved geometry which is serpentine or sinusoidal in shape corresponding to the letter.

8. A musical instrument as claimed in claim 1, further comprising at least a second tuned sound port with each tuned sound port being symmetrically arranged to funnel sound through at least one tuned sound port.

9. A musical instrument as claimed in claim 5 wherein the panels are symmetrically arranged on opposite sides of the sound hole.

10. A musical instrument as claimed in claim 9 wherein the panels extend symmetrically from opposite sides of the musical instrument and from opposite ends thereof.

11. A musical instrument as claimed in claim 5 further comprising a dual bridge arrangement having a first bridge mounted on the anatomical front sound board, a second bridge mounted on the anatomical rear board and sonic structural support posts interconnecting the first bridge to the second bridge.

12. An acoustic musical instrument comprising a hollow or semi-hollow acoustic body, a front and rear surface, at least one sound board representing either the anatomical front surface or the anatomical rear surface of the hollow body, an outer rim connecting the front surface and the rear surface, and a top end and a bottom end, having at least one tuned sound port defined in a top end, said tuned port extending into the interior of the musical instrument through which sound can exit with the tuned sound port comprising a hollow member adapted to be inserted through a hole, said hole formed at the top end of the musical instrument and having a central opening of predetermined geometry and a length extending a fixed distance from the hole through which the tuned sound port is inserted, wherein the length of the hollow member extends into the interior of the musical instrument a minimum fixed distance equal to at least ¼ of the diameter of the central opening of the port and within a range of plus or minus 20%, a sound hole other than the tuned sound port, and a panel disposed within the hollow body, said panel extending between the front and rear sound boards and interconnecting the front and rear surfaces of the hollow body, said panel disposed near an end of the musical instrument and extends to a position relatively near a center of the instrument, wherein said panel funnels sound toward said tuned sound port.

13. A musical instrument as defined in claim 12 further comprising at least one tuned sound port extending into the hollow body of the musical instrument through which sound can exit with the tuned sound port comprising a hollow member adapted to be inserted through an opening formed in the body of the musical instrument and with the hollow member having a central opening of predetermined geometry and length extending a fixed distance from the hole through which the tuned sound port is inserted.

14. A musical instrument as defined in claim 13 wherein the hollow member extends a minimum fixed distance from the opening equal to at least ¼ of the diameter of the ported opening within a range of plus or minus 20%.

15. A musical instrument as defined in claim 14 wherein the panel has a curved geometry.

16. A musical instrument as defined in claim 13 wherein the musical instrument is a stringed musical instrument.

17. A musical instrument as defined in claim 1 further comprising a bridge and saddle assembly mounted on the anatomical front sound board of the musical instrument with the bridge and saddle assembly comprising a saddle having a body and at least one conventional transducer pick up for converting vibrations from the strings in the musical instrument into electrical signals.

18. A musical instrument as defined in claim 17 wherein said at least one conventional transducer pick up is directly incorporated into the body of the saddle.

19. A musical instrument as defined in claim 14, further comprising at least a second panel, wherein the panel has a flat geometry.

20. A musical instrument as defined in claim 12, said position relatively near a center of the instrument is in a bottom end of said musical instrument.

* * * * *